US006368132B1

(12) United States Patent
Okayasu

(10) Patent No.: US 6,368,132 B1
(45) Date of Patent: Apr. 9, 2002

(54) CONNECTOR

(75) Inventor: Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/678,336

(22) Filed: Oct. 3, 2000

(30) Foreign Application Priority Data

Oct. 4, 1999 (JP) ..... 11-283221

(51) Int. Cl.[7] ..... H01R 13/52
(52) U.S. Cl. ..... 439/273; 439/275
(58) Field of Search ..... 439/271–275, 439/587–589

(56) References Cited

U.S. PATENT DOCUMENTS 5,993,233 A * 11/1999 Fukuda ..... 439/271
6,045,383 A * 4/2000 Fujiwara ..... 439/271
6,186,814 B1 * 2/2001 Matsushita ..... 439/271

FOREIGN PATENT DOCUMENTS

JP 8-45601 2/1996

* cited by examiner

*Primary Examiner*—Khiem Nguyen
(74) *Attorney, Agent, or Firm*—Banner & Witcoff, Ltd.

(57) ABSTRACT

To prevent vibration between male and female housings of electrical connectors, a flange 44 is formed on an outer circumference of a posterior end of a sealing ring 40, an outer edge of this flange 44 reaching to a location at the approximate center of an anterior edge 12A of a small hood 12. A tapered face 45 is formed at a corner portion of an anterior face of the outer edge of the flange 44. When the fitting operation approaches its final stage, the anterior edge 12A of the small hood 12 presses the tapered face 45 of the flange 44, gripping the flange 44 between this anterior edge 12A and an innermost wall 22A. Consequently, the outer edge of the flange 44 is resiliently compressed in the direction of thickness thereof, and a force is exerted on the flange 44, pushing it outwards. When a female housing 20 is pushed in to a specified position, a locking arm 30 returns to its original position, the female housing 20 is pushed towards the posterior by the returning force of the flange 44, moving in the direction of thickness thereof, and a stopped face 35 of the locking arm 30 is pressed resiliently by a stopping member 15.

12 Claims, 5 Drawing Sheets

CONNECTOR

TECHNICAL FIELD

The present invention relates to an electrical connector provided with a means to prevent terminal fittings from rubbing against each other and becoming abraded.

BACKGROUND TO THE INVENTION

A conventional connector is configured so as to be provided with a pair of male and female connector housings, each having terminal fittings attached thereto, one of these connector housings having a locking arm capable of being resiliently inclined, this locking arm having a stopped member. When the two connector housings are to be fitted together, the locking arm is inclined; the male and female terminal fittings then reach a correct fitted state and make contact, the locking arm returns to its original position. And the stopped member thereof engages with a stopping member of the corresponding housing. The two connector housings are thereby maintained in a fitted state.

In the case described above, the locking mechanism is provided with the inclinable locking arm which, in order to be inclined above or below the corresponding stopping member, needs a specified clearance between the stopped member of the locking arm and the corresponding stopping member. If this clearance is provided, there is the problem that the two housings rattle against each other if they are installed in a location prone to vibration from the exterior, contacting members of the male and female terminal fittings repeatedly rub against one another, and this causes damage such as contacting members gradually being abraded and their contacting force decreasing.

A means to prevent rattling between the male and female housings, so as to prevent the terminal fittings from rubbing against each other and becoming abraded, has been set forth by the present applicant in Japanese Utility Model Registration Number 2542630.

As shown in FIG. 7 of this application, a sealing ring 5 is attached between a terminal housing 2 of a female housing 1 and a hood member 4 of a male housing 3. A flange 5A is provided on a posterior outer circumference of the sealing ring 5, this flange 5A fitting between an anterior edge of the hood member 4 and a protruding wall 6 of the female housing 1, this protruding wall 6 being opposite the anterior edge of the hood member 4. When the fitting of the two housings 1 and 3 is almost completed, the flange 5A of the sealing ring 5 is squeezed resiliently between the hood member 4 and the protruding wall 6. The returning force of the flange SA causes the two housings 1 and 3 to move in a direction of separation, and a stopped member 7A of a locking arm 7 fits tightly with a stopping member 8, thereby preventing the male and female housings 1 and 3 from vibrating against each other.

However, in the above proposal, the flange 5A of the sealing is simply squeezed between the hood member 4 and the protruding wall 6. Consequently, when the flange 5A receives a pushing force, the outer edge thereof moves outwards, and since the pushing force onto the terminal housing 2 is weakened at a posterior edge of the sealing ring 5, the amount of resilient strength which is exercised may be insufficient, and the seal may be damaged.

Further, there is the danger of permanent set-in fatigue in the flange 5A if it is overly compressed. Consequently, a means to prevent this problem is required. In the above proposal, a protrusion 9 protrudes from the protruding wall 6, this protrusion 9 approaching a cut-away member 9A formed in the flange 5A. The anterior edge of the hood member 4 makes contact with the protrusion 9 and prevents further movement in the anterior direction, thereby preventing the flange 5A from being overly compressed. However, this configuration has the problem of being somewhat complex, and an improved solution is required.

The present invention aims to provide the required improvement.

SUMMARY OF THE INVENTION

According to the invention there is provided an electrical connector comprising a pair of connector housings adapted for mutual fitting together in a fitting direction, one of said housings having a resilient locking arm adapted to engage the other of said housings to maintain said housings in a fitted state, and a resilient sealing ring being provided between respective circumferential faces of said housings, charactertised in that said sealing ring has a continuous radially outwardly extending flange adapted to be gripped between opposed faces of said connector housings in the fitted condition, one of the sealing ring and connector housings having a pushing surface at an angle to said fitting direction and adapted to urge the outer edge of said flange radially inwardly.

Preferably the pushing surface is provided on the sealing ring and faces said other housing. The pushing surface may be flat or acruate. The pushing surface may alternatively be provided on one or other of said connector housings.

The sealing ring preferably has a tubular portion insertable in a corresponding aperture of one of said housings. The tubular portion may have outer peripheral sealing lips, and internal grooves to improve sealing thereof in said aperture.

BRIEF DESCRIPTION OF DRAWINGS

Other features of the invention will be apparent from the following description of a preferred embodiment by way of example only in the accompanying drawings in which.

DESCRIPTION OF PREFERRED EMBODIMENT

An embodiment of the present invention is described below with the aid of FIGS. 1 to 6.

Figure 1:
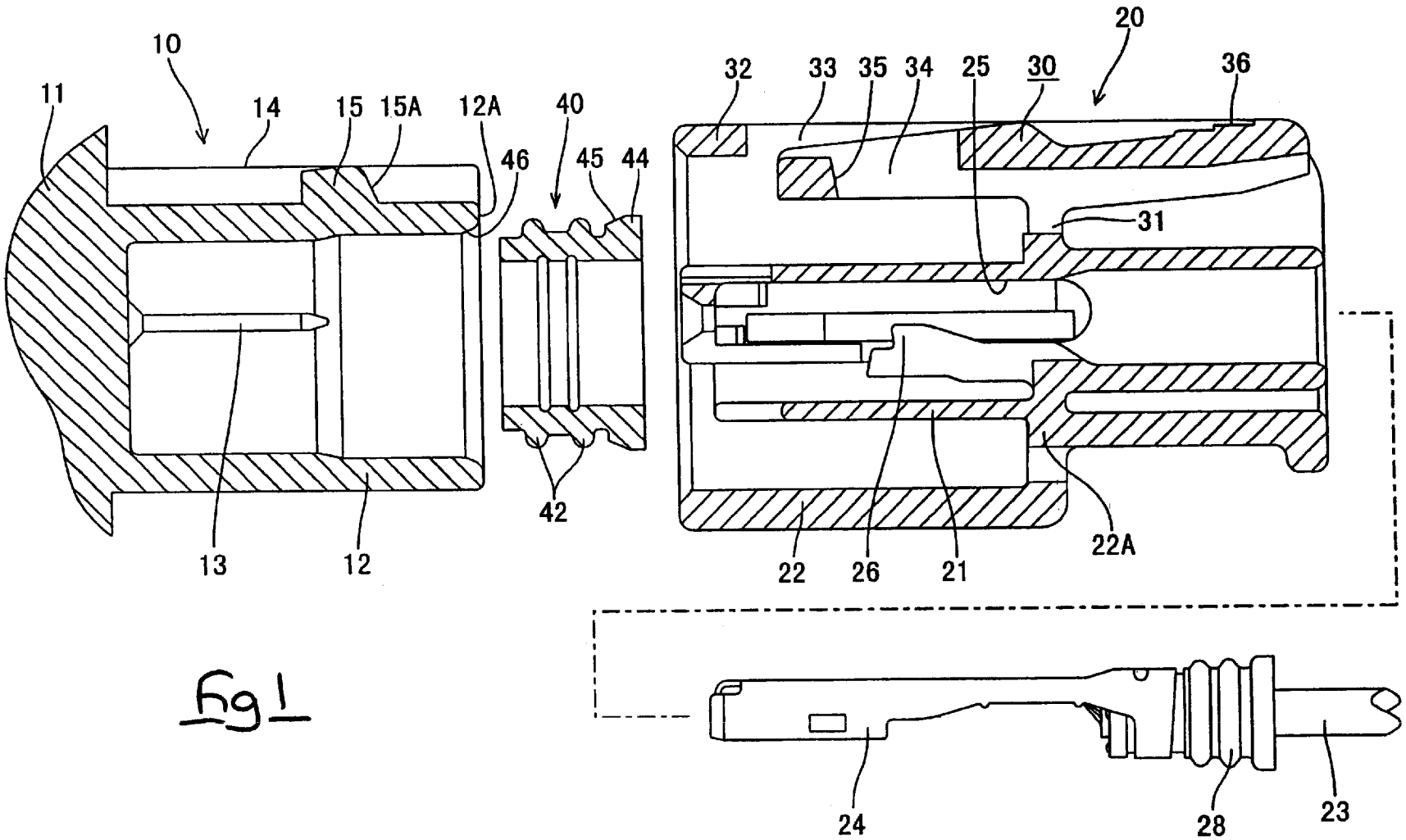
FIG. 1 is a disassembled vertical cross-sectional view of an embodiment of the present invention.

As shown in FIG. 1, a waterproof connector is provided with a male connector housing 10 (hereafter referred to simply as male housing) and a female connector housing 20 (hereafter referred to simply as female housing), these male and female housings 10 and 20 fitting mutually together. Hereafter, fitting sides of the male and female housings are designated as the anterior.

The male housing 10 is formed in a unified manner with an electrical device 11, this male housing 10 having a rectangular small hood 12 protruding in an anterior direction. A plurality of terminal fittings 13 protrude from an innermost wall of the small hood 12, these terminal fittings 13 being tab-shaped and being horizontally aligned with specified spaces therebetween. A parallel pair of guiding walls 14 are formed on an upper face of the small hood 12, these guiding walls 14 being provided at a central location relative to the width-wise direction and facing an anterior-posterior direction. A stopping member 15 protrudes at a location between and slightly to the anterior of the two guiding walls 14. An anterior face of this stopping member 15 is inclined sharply, forming a tapered face 15A.

Figure 2:
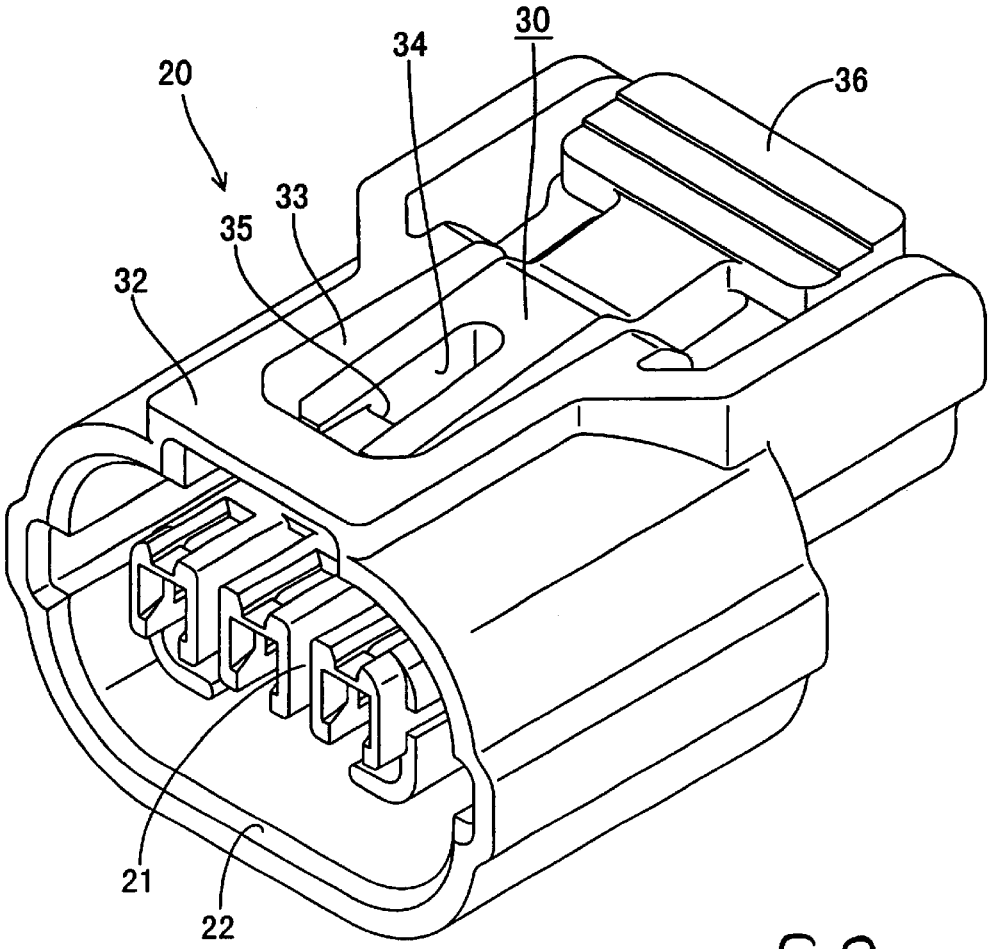
FIG. 2 is a diagonal view of a female housing.

The female housing 20 is provided with a terminal housing 21, this terminal housing 21 fitting into the small hood 12 and having a prescribed clearance therewith. As shown in FIG. 2, a large hood 22 is formed around an anterior half of the terminal housing 21, this large hood 22 fitting tightly with outer sides of the small hood 12. The terminal housing 21 is provided with cavities 25, these housing female terminal fittings 24. These cavities 25 correspond in number to the number of male terminal fittings 13 of the male housing 10. The female terminal fittings 24 are inserted from the posterior into the cavities 25 and are retained by lances 26 formed on base faces of the cavities 25. The female terminal fittings 24 are then doubly retained by a front retainer (not shown).

A locking arm 30 is formed on an upper face of the female housing 20. This locking arm 30 is thin and narrow in the anterior-posterior direction and inclines in a see-saw shape with a fulcrum 31 serving as its centre, this fulcrum 31 being provided at a location approximately identical with an innermost wall 22A of the large hood 22. A protruding member 32 is formed on an upper face of the large hood 22, at a central location in a width-wise direction thereof. A recess 33 is formed in this protruding member 32, a posterior end of the recess 33 being open. When an anterior end of the locking arm 30 is inclined upwards, it is housed within this recess 33. The anterior end of this locking arm 30 is capable of advancing in a straight line, being guided by the two guiding walls 14 of the male housing 10. A groove 34 is formed in the locking arm 30 from a location slightly inwards from the anterior end thereof and extending towards the posterior. An anterior end of this groove 34 forms a stopped face 35 capable of engaging with the stopping member 15 of the male housing 10.

An upper face of a posterior end of the locking arm 30 has a pressing member 36 formed thereon for releasing the lock, and has a space between this upper face and an upper face of a posterior half of the terminal housing 21, this space permitting the posterior end of the locking arm 30 to be inclined downwards.

Figure 3:
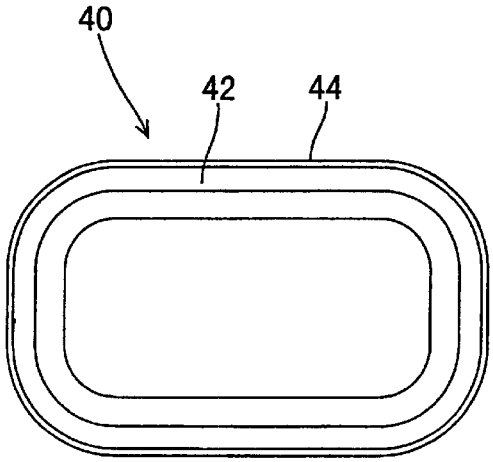
FIG. 3 is a front view of a sealing ring.

A resilient sealing ring 40 made from rubber or the like is attached to the circumference of the terminal housing 21 of the female housing 20 at a location immediately to the anterior of the innermost wall 22A of the large hood 22. As shown in FIG. 3, the sealing ring 40 has a rectangular ring shape and is resiliently compressed between an outer circumference of the terminal housing 21 and an inner circumference of an anterior end of the small hood 12, thereby forming a seal. Two lips 42 are formed along the entire outer circumference of this sealing ring 40.

A flange 44 is formed along the entire outer circumference of a posterior end (the right side in FIG. 1) of the sealing ring 40, this flange 44 being thicker and slightly higher than the lips 42. An outer edge of the flange 44 reaches a location at the approximate centre of the anterior edge 12A of the small hood 12. A tapered face 45, as illustrated, is formed at a corner portion of an anterior face side of the outer edge of the flange 44. A rounded edge 46 is provided at the opening of the inner circumference side of the anterior edge 12A of the small hood 12.

Figure 4:
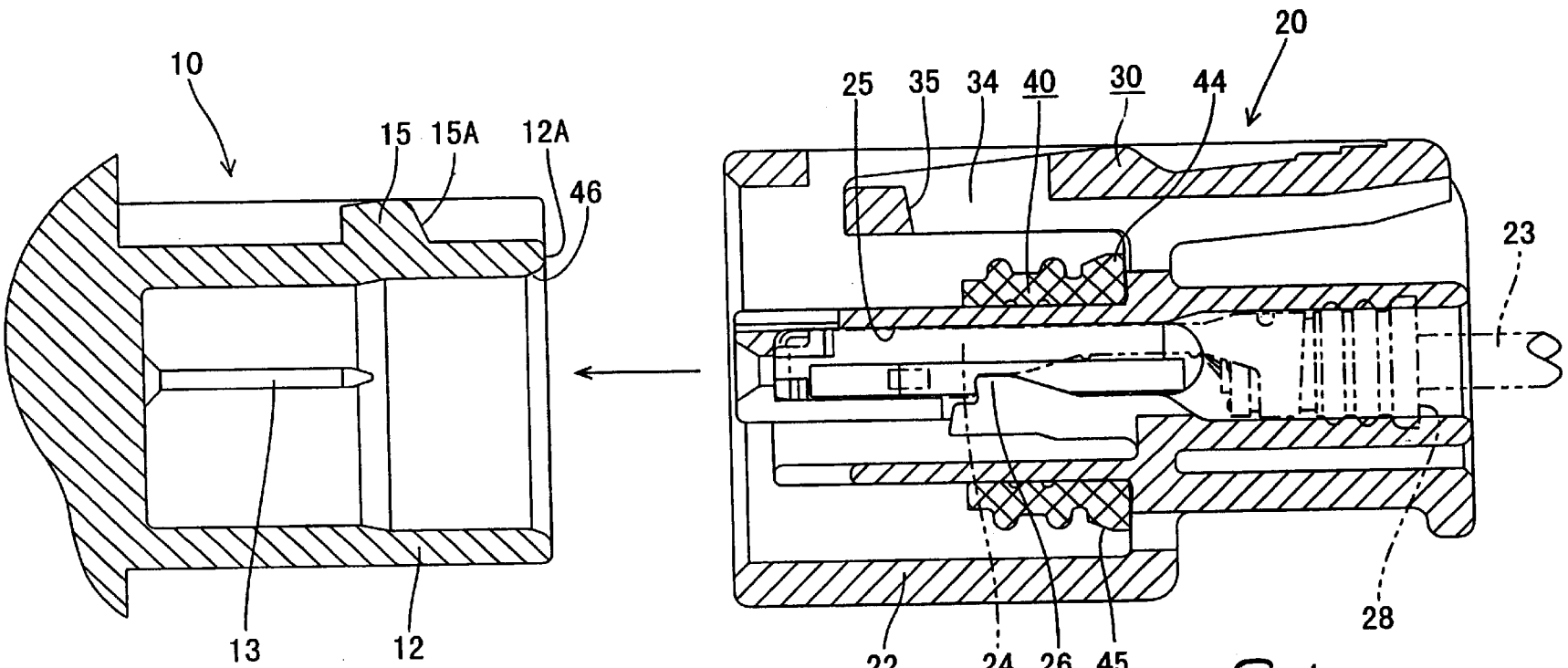
FIG. 4 is a vertical cross-sectional view showing male and female housings in a state prior to being fitted together.

Next, the operation of the present embodiment is explained. As shown in FIG. 4, the sealing ring 40 is fitted around the terminal housing 21 of the female housing 20, and is pushed in until it makes contact with the innermost wall 22A. The female terminal fittings 24, which have ends of electric wires 23 fixed thereto, are pushed from the posterior into the cavities 25. These are retained by the lances 26, and a rubber stopper 28 is fixed to the posterior of each female terminal fitting 24 so as to cover the opening of each cavity 25. Next, the retainer (not shown) is fitted to an anterior face of the terminal housing 21, thereby doubly retaining the female terminal fittings 24, and retaining the sealing ring 40 in an anterior direction.

Figure 5:
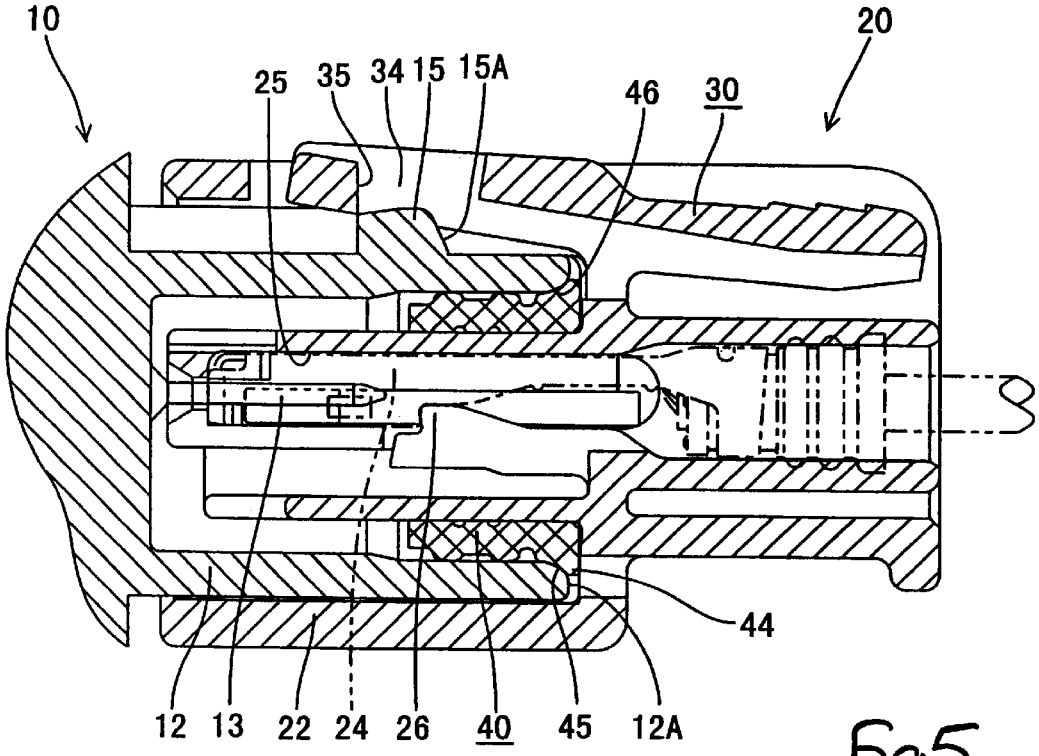
FIG. 5 is a vertical cross-sectional view showing the male and female housings in the final stage of being fitted together.
Figure 6:
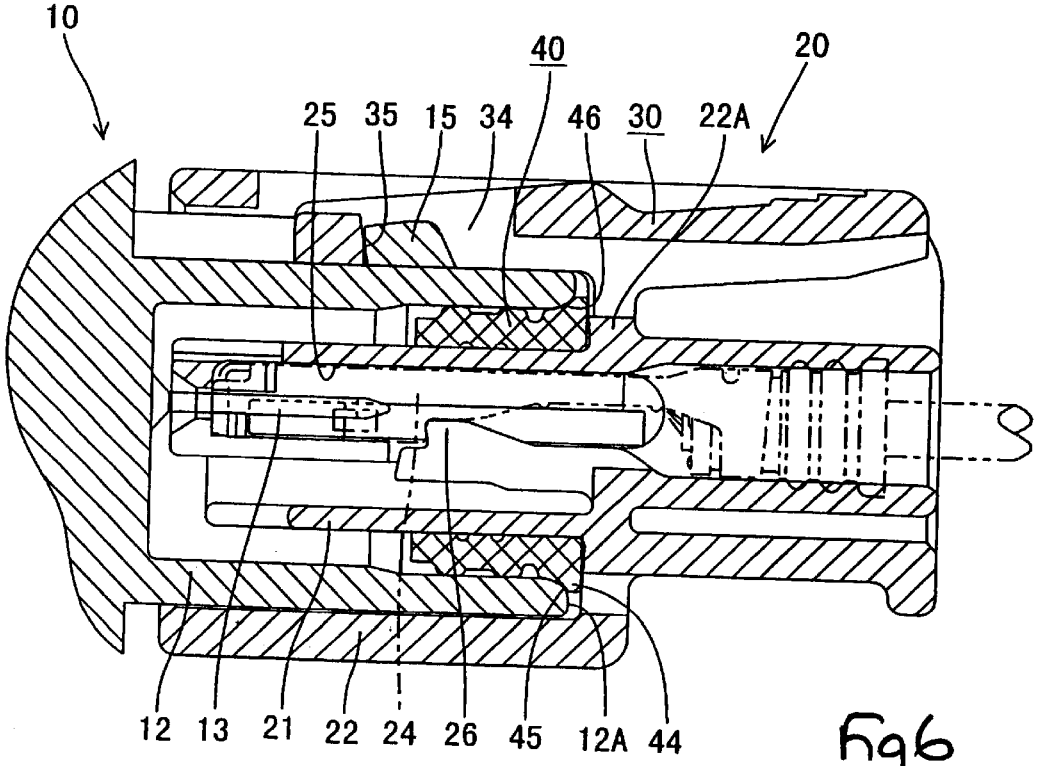
FIG. 6 is a vertical cross-sectional view showing the male and female housings fitted together.
Figure 7:
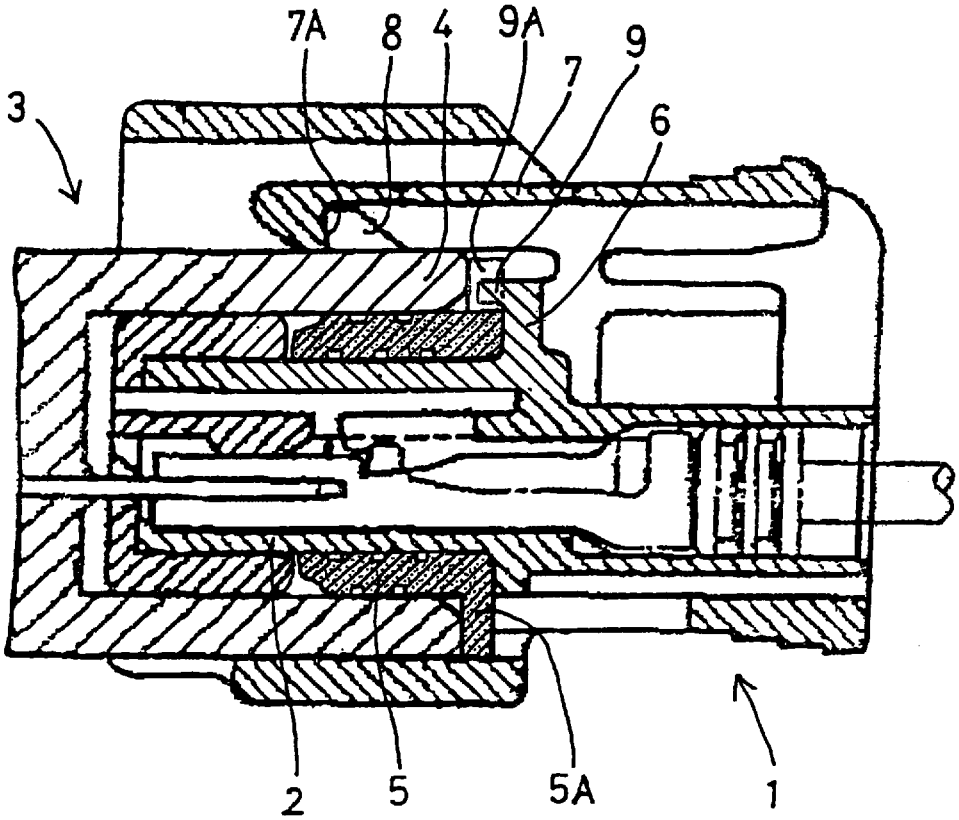
Fig7 PRIOR ART
FIG. 7 is a vertical cross-sectional view of a prior art example.

From this state, as shown by the arrow in FIG. 4, the female housing 20 is fitted to the male housing 10. As this fitting progresses, the anterior end of the locking arm 30 makes contact with the tapered face 15A of the stopping member 15 of the male housing 10, and the anterior end of the locking arm 30 is pushed so as to incline upwards and pass over the stopping member 15. As the fitting operation approaches its final stage, the anterior edge 12A of the small hood 12 of the male housing 10 approaches the innermost wall 22A of the large hood 22 of the female housing 20. Consequently, as shown in FIG. 5, the flange 44 of the sealing ring 40 is resiliently compressed between the anterior edge 12A of the small hood 12 and the innermost wall 22A of the large hood 22. The portion of the anterior edge 12A of the small hood 12 provided with the rounded edge 46 pushes the tapered face 45 at the corner of the anterior face of the flange 44, exerting a force to resiliently compress the outer edge of the flange 44 in the direction of thickness thereof and also push the flange 44 in the direction of the outer circumference of the terminal housing 21.

As a result, the female housing 20 is pushed in to a specified position, contacting members of the male and female terminal fittings 13 and 24 make contact and, as shown in FIG. 5, the stopped face 35 of the locking arm 30 passes beyond the location of the stopping member 15. Consequently, when the locking arm 30 returns to its original position, the stopping member 15 fits within the groove 34 and is locked. At this juncture, a clearance ordinarily appears between the stopped face 35 of the locking arm 30 and the stopping member 15. However, as shown in FIG. 5, at the time when the locking arm 30 returns to its original position, the female housing 20 is pushed in the posterior direction (to the right in FIG. 6) by the returning force of the flange 44 of the sealing ring 40, this returning force being exerted in the direction of thickness thereof. Consequently, the stopped face 35 of the locking arm 30 is pressed resiliently against the stopping member 15.

Consequently, the male and female housings 10 and 20 do not vibrate against each other and the male and female terminal fittings 24 and 13 do not rub against each other. By this means, abrasion of the connecting members of the male and female terminal fittings 124 and 13 is prevented, a good connecting state can be attained, and the connecting pressure is maintained over a long period.

The tapered face 45 is formed at the corner of the anterior face of the outer edge of the flange 44 of the sealing ring 40, this tapered face 45 pushing the innermost wall 22A of the large hood 22 via the anterior edge 12A of the small hood 12.

Consequently, the flange 44 receives a pushing force which pushes it towards the outer circumference of the terminal housing 21, and a suitable force is also exerted o the posterior end of the sealing ring 40, thereby allowing a good seal along the entire width of the sealing ring 40.

Furthermore, an outer circumference of an anterior edge 12A of the small hood 12 protrudes further to the exterior than the outer edge of the flange 44 of the sealing ring 40. This anterior edge 12A protrudes outward from the small hood 12 and makes contact with the innermost wall 22A of the large hood 22. Consequently, further advancement of the small hood 12 is prevented, and the flange 44 is not overly compressed. That is, over-compression of the flange 44 is prevented without increasing the complexity of the configuration.

The present invention is not limited to the embodiments described above with the aid of figures. For example, the possibilities described below also lie within the technical range of the present invention. In addition, the present invention may be embodies in various other ways without deviating from the scope thereof.

(1) The tapered face for exerting a gripping force and pushing the outer edge of the flange of the sealing ring inwards may be provided on a corner of the posterior face of the flange. Further, it may be provided on the small hood which make contact with the outer edge of the flange, or on the innermost wall of the large hood. Moreover, tapered faces may be provided on the flange as well as on the anterior edge of the small hood, or on the flange as well as the innermost wall of the large hood.

(2) The locking arm is not limited to moving in the see-saw shape described above. A locking arm provided in a cantilevered shape and inclining from a base end is equally suitable for the present invention.

(3) A configuration is equally suitable for the present invention whereby the locking arm and the stopping member which engages therewith are provided on the opposite housings to those on which they are provided in the present embodiment.

What is claimed is:

1. An electrical connector comprising a pair of connector housings adapted for mutual fitting together in a fitting direction, one of said housings having a resilient locking arm, a circumferential wall surrounding a cavity for at least one terminal fitting, and a radial wall projecting outward from the circumferential wall, the other of said housings having a tubular member surrounding a cavity for at least one terminal fitting, the tubular member including a locking member that engages the locking arm to maintain said housings in a fitted state, and a resilient sealing ring placed about the circumferential wall and against the radial wall of said one housing such that the sealing ring is gripped between the circumferential wall and the tubular member when the housings are fitted together, wherein said sealing ring has an inner end with a continuous radially outwardly extending flange having a free end that projects radially beyond other portions of the sealing ring, and wherein one of the free end of the flange of the sealing ring and the tubular member has a pushing surface at an angle to said fitting direction to contact the other of the free end of the flange and the tubular member to urge the sealing ring radially inwardly against the circumferential wall and rearwardly against the radial wall to thereby form a secure seal between the sealing ring and the one housing, and to urge the tubular member outward so that the locking member is pressed against the locking arm of the other housing to thereby alleviate looseness between the housings.

2. A connector according to claim 1 wherein said pushing surface is provided on said sealing ring.

3. A connector according to claim 2 wherein said pushing surface faces towards said other housing.

4. A connector according to claim 3 wherein said pushing surface is flat.

5. A connector according to claim 3 wherein the outer edge of said flange is aligned with said fitting direction and has a predetermined width, said pushing surface being provided at one side thereof.

6. A connector according to claim 4 wherein the outer edge of said flange is aligned with said fitting direction and has a predetermined width, said pushing surface being provided at one side thereof.

7. A connector according to claim 1 wherein said pushing surface is provided on said other housing.

8. A connector according to claim 7 wherein said pushing surface is arcuate.

9. A connector according to claim 1 wherein said sealing ring includes an axially extending tubular portion insertable in a corresponding aperture of one of said housings.

10. A connector according to claim 9 wherein said tubular portion has peripheral annular sealing projections for engagement in said aperture.

11. A connector according to claim 9 wherein said tubular portion has an internal circular recess to locally reduce the wall thickness thereof.

12. A connector according to claim 10 wherein said tubular portion has an internal circular recess to locally reduce the wall thickness thereof.

* * * * *